US005551388A

United States Patent [19]

Slee

[11] Patent Number: 5,551,388

[45] Date of Patent: Sep. 3, 1996

[54] PISTON WITH CAVITY

[75] Inventor: Roger H. Slee, Warwick, England

[73] Assignee: T&N Technology Limited, Rugby, England

[21] Appl. No.: 500,851

[22] PCT Filed: Feb. 23, 1994

[86] PCT No.: PCT/GB94/00357

§ 371 Date: Aug. 4, 1995

§ 102(e) Date: Aug. 4, 1995

[87] PCT Pub. No.: WO94/20241

PCT Pub. Date: Sep. 15, 1994

[30] Foreign Application Priority Data

Mar. 5, 1993 [GB] United Kingdom ..... 9304528

[51] Int. Cl.[6] ..... B22D 19/00

[52] U.S. Cl. ..... 123/193.6; 29/888.047

[58] Field of Search ..... 123/193.6, 276, 123/279, 256; 29/888.04, 888.042, 888.044, 888.047; 164/112, 98

[56] References Cited

U.S. PATENT DOCUMENTS

| | | | |
|---|---|---|---|
| 4,559,685 | 12/1985 | Hara | 29/888.047 |
| 4,712,600 | 12/1987 | Hamajima | 29/888.047 |
| 4,776,075 | 10/1988 | Kawabata et al. | 29/888.047 |
| 4,898,135 | 2/1990 | Failla | 123/279 |
| 5,121,722 | 6/1992 | Horiuchi | 123/193.6 |
| 5,224,449 | 7/1993 | Fukano | 123/193.6 |
| 5,273,009 | 12/1993 | Ozawa | 123/193.6 |

FOREIGN PATENT DOCUMENTS

| | | | |
|---|---|---|---|
| 118204 | 9/1984 | European Pat. Off. | B22D 15/02 |
| 2676015 | 11/1992 | France | B22D 19/00 |
| 833320 | 4/1960 | United Kingdom . | |

OTHER PUBLICATIONS

Patent Abstracts of Japan, vol. 10, No. 88 (M–467) [2145], 5 Apr. 1986 "Production of Piston".

Patent Abstracts of Japan, vol. 9, No. 282 (M–428) [2005], 9 Nov. 1985 "Combustion Chamber for Direct–Injection Diesel Engine and Manufacturing Thereof".

*Primary Examiner*—Marguerite McMahon

*Attorney, Agent, or Firm*—Synnestvedt & Lechner

[57] ABSTRACT

A piston (10) containing a cavity (16) is manufactured by forming a box (20; 50; 70; 80). The interior of the box defines the cavity (16). The box ms mounted in a die cavity (26) and the piston is cast around the box. The box is provided with projections (22*c;* 24*c;* 52; 58; 73) which enter recesses in the wall of the die cavity and support the box. After removing the piston from the die cavity, the projections are machined off.

7 Claims, 3 Drawing Sheets

PISTON WITH CAVITY

This invention is concerned with a method of manufacturing a piston having a cavity therein and with such a piston.

In some cases, it is necessary to provide pistons for internal combustion engines, or other purposes, with cavities. The term "cavity" is used herein to denote a substantially enclosed space having only restricted openings whereas the term "recess" is used to denote a space having a relatively large opening. For example, pistons have been proposed which have cavities in the crown thereof having one or more restricted openings which communicate with a combustion .recess in the crown. The combustion recess co-operates with the space above the crown of the piston in the cylinder in which it reciprocates to form a combustion chamber in which the fuel charge is burnt. These cavities (see U.S. Pat. No. 4,898,135) are intended to provide reaction chambers to shelter radical species of the fuel from being exhausted from the cylinder so that they can return to the cylinder to seed subsequent fuel charges. Such seeding improves the completeness of the combustion of the fuel.

The cavities to provide the aforementioned reaction chambers have hitherto been provided by manufacturing the piston in two halves, viz a lower half and an upper half which is subsequently secured to the top of the lower half. The lower half defines a lower potion of the combustion recess and also a lower portion of the reaction cheer, including the lower part of the restricted opening or openings of the reaction chamber. The upper half defines upper side portions of the combustion recess and an upper portion of the reaction chamber, including an upper part of the restricted opening or openings. The upper and lower halves of the piston can be secured together by bolts or electron beam welding. Thus, the manufacture of such pistons is complex and the possibility exists that the two halves of the piston may become detached in service. An alternative way of providing the restricted openings is to form bores through the material of the piston after the two halves thereof have been secured together. Where such bores are used, a slow process is involved because the bores are usually of small diameter and relatively long.

It is an object of the present invention to provide a method of manufacturing a piston having a cavity therein which is less complex and produces a more reliable piston.

The invention provides a method of manufacturing a piston having a cavity therein, wherein the method comprises forming a box, the box having an interior which is the size and shape of the required cavity, providing the box with at least one external projection by which the box can be supported, mounting the box in a die cavity bounded by a wall having the shape of the required piston, introducing molten metal into the die cavity so that the metal envelopes the box without entering the interior thereof, allowing the metal to solidify, and removing the piston from the die cavity, characterised in that said box is mounted in the die cavity with said external projection extending into a recess in the wall of the die cavity and resting on an abutment in said recess so that said projection serves to support and orientate the box in the cavity, machining off the portion of the projection which extends beyond the cast metal after the piston has been removed form the die cavity, and forming an opening of said cavity in a combustion recess in a crown of the piston.

In a method in accordance with the invention, the piston is essentially in one piece which is cast around the box, the piston is thus, unlikely to come apart in service, and is relatively simple to manufacture. The method can be used to provide a piston with the aforementioned reaction chambers.

Preferably, the box is formed with at least one tube projecting therefrom, the tube forming at least part of an opening of the cavity. This avoids the necessity of forming a bore to provide a restricted opening of the cavity. If desired, the tube can be used to allow air to vent from the interior of the box during casting of the metal. The tube can be utilised as the external projection by which the box is supported and orientated. There may be a plurality of tubes associated with a single box.

Since it is frequently required that there should be a plurality of the aforementioned reaction chambers surrounding the combustion recess of a piston, the box may be formed as part of an assembly of similar boxes each enclosing a reaction chamber, the boxes being held, possibly by struts joining adjacent boxes, in fixed positions relative to one another.

Preferably, the box or boxes are formed from two pieces of sheet metal, for example sheet steel may be used having a thickness of approximately 0.5 mm. In each of which sheets at least one recess is formed, the sheets are then placed in overlying relationship so that the recesses co-operate in forming a cavity, and the sheets are then joined together. For example, two sheets of metal can be pressed to form half cavities which are bordered by flanges which can be joined together to complete a box by, for example, welding or crimping. In this case, the aforementioned tubes can be positioned between the flanges of the two sheets.

The box or boxes may, alternatively, be formed from sheet material in tubular form. For example, each box may be formed from a length of tube plugged at each end. An assembly of boxes may be formed from a single tube which is bent into the required shape and then crushed between the boxes to separate the interior of the boxes from one another. Another alternative for making the boxes is to machine a blind hole into a bar and then plug the entrance.

The invention also provides a piston comprising cast metal, wherein the piston also comprises a box enclosed within the cast metal, the interior of the box defining the size and shape of a cavity within the piston, characterised in that the piston also comprises at least one tube communicating with the interior of the box and extending through the cast metal to an opening in a combustion recess of a crown of the piston.

In a piston in accordance with the invention, the box may be one of a plurality of similar boxes enclosed within the cast metal, said boxes being joined to one another by struts extending through the cast metal.

There now follow detailed descriptions, to be read with reference to the accompanying drawings, of pistons and methods of manufacturing a piston which are illustrative of the invention.

Figure 3:
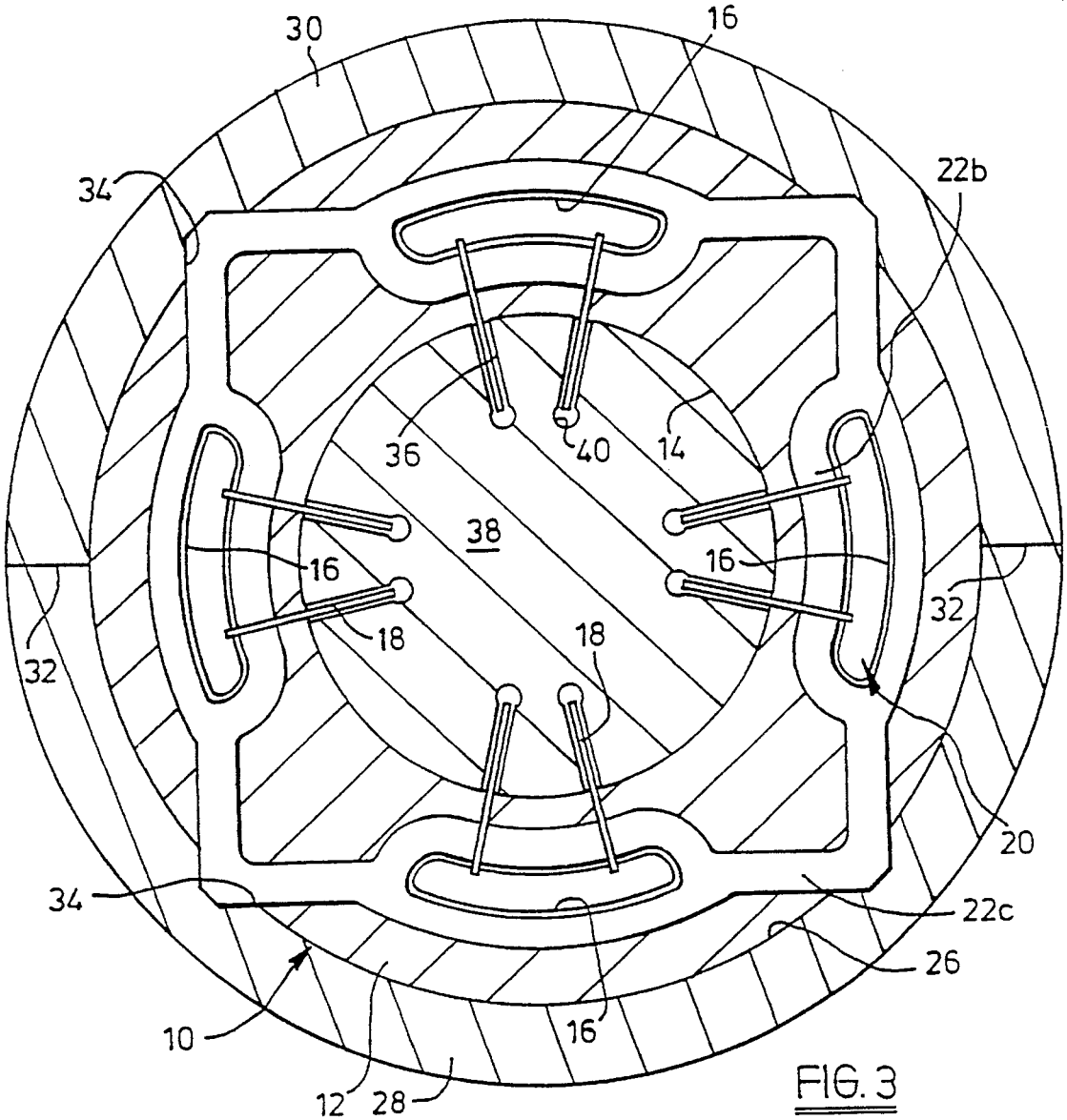
FIG. 3 is a horizontal cross-sectional view taken through a piston made by the first illustrative method, showing it in position in a casting die cavity.

The first illustrative method is for manufacturing a piston 10 comprising a crown 12 (FIG. 3) which defines a combustion recess 14 which opens upwardly. The piston has four cavities therein Which form four reaction chambers 16 which are distributed evenly around the recess 14. Each chamber 16 communicates with the combustion recess 14 through two restricted openings provided by tubes 18.

Figure 1:
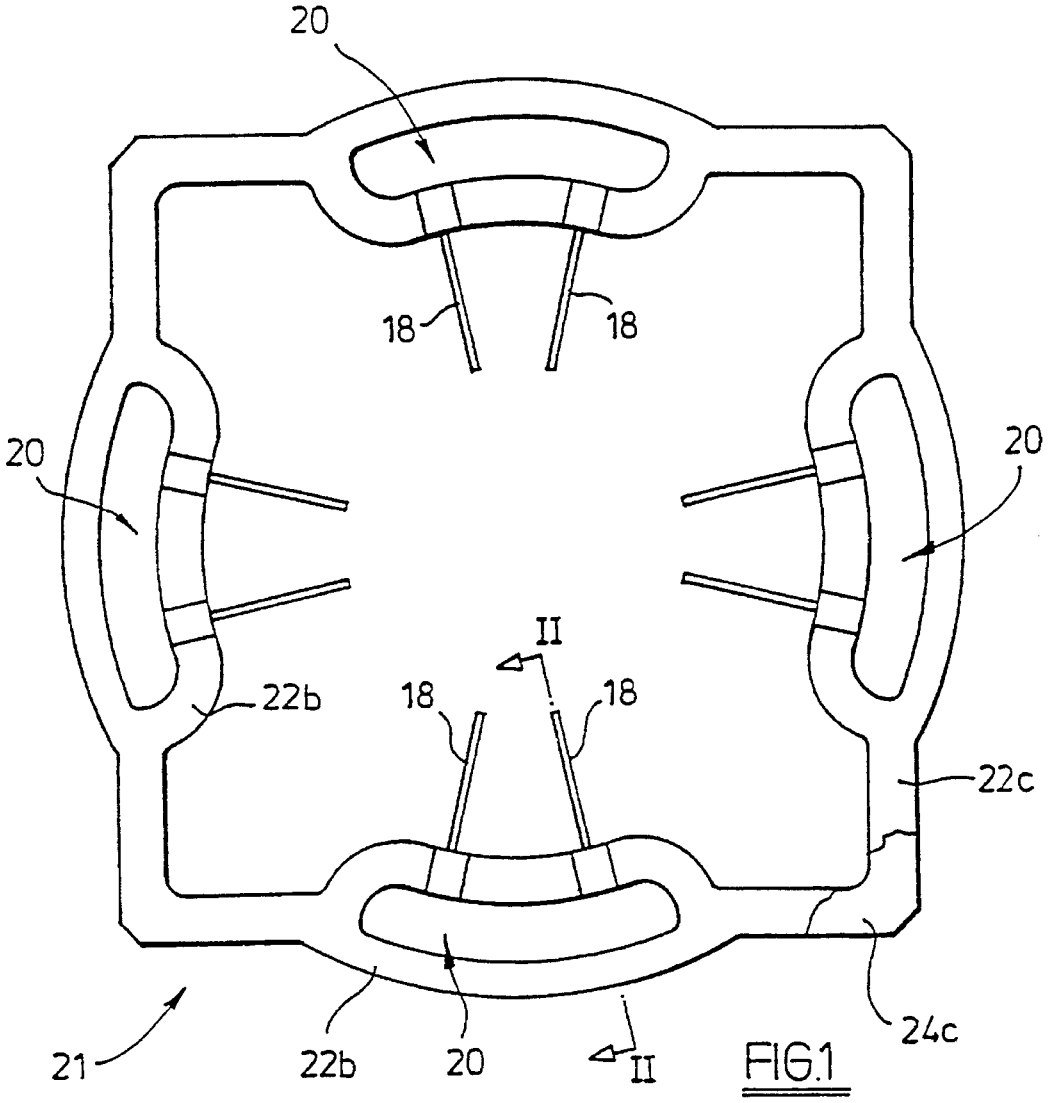
FIG. 1 is a plan view of an assembly of boxes used in a first illustrative method.
Figure 2:
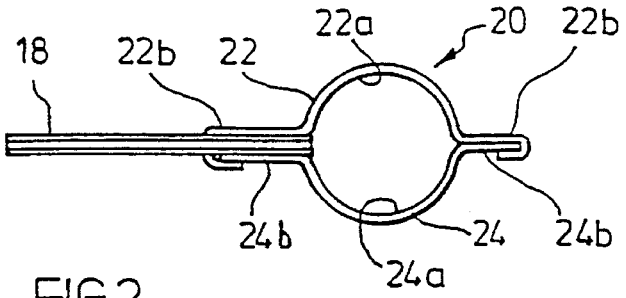
FIG. 2 is a cross-sectional view on an enlarged scale, taken on the line II—II in FIG. 1.

The first illustrative method comprises forming an assembly 21 of four substantially enclosed boxes 20 from sheet material. Each box 20 has an interior which is the size and shape of the required cavity providing a reaction chamber 16. The boxes 20 are formed from two sheets of steel 22 and 24 which are both approximately 0.5 mm thick. The sheets 22 and 24 are each pressed to form four recesses 22*a* and 24*a* respectively. These recesses 22*a* and 24*a* are generally semi-circular in cross-section when viewed at right angles to the plane of the sheets (see FIG. 2). In the plane of the sheets 22 and 24, the recesses 22*a* and 24*a* are elongated and arcuate about a common centre. The sheets 22 and 24 are cut out to form flanges 22*b* and 24*b*, respectively, around the recesses 22*a* and 24*a*. The sheets 22 and 24 are also cut out to form webs 22*c* and 24*c* interconnecting the flanges 22*b* and 24*b*. The webs 22*c* and 24*c* form right angled struts joining adjacent flanges 22*b* and 24*b* so that the assembly has the approximate shape of a square. The webs 22*c* and 24*c* provide the boxes 20 with a plurality of external projections by which the boxes can be supported.

The tubes 18 are fine bore tubes and two are associated with each box 20. They may be soldered to the flanges 24*b* before the boxes 20 are assembled. The flanges 22*b* and 24*b* are crimped around the tubes 18 to hold them in position and to prevent access of molten metal around the tube 18. The bore of each tube 18, communicates with the interior of the box 20 with which it is associated. The tubes 18 project generally horizontally towards the centre of the piston 10. Tubes of the type used as hyperdermic needles are suitable for use as the tubes 18. The ends of the tubes 18 which are remote from the boxes 20 are left open to allow venting of air from the interior of the boxes 20 during casting.

In the first illustrative method, the boxes 20 are mounted in a die cavity 26 (see FIG. 3) in which the piston is cast. The die cavity 26 is defined by two half die pieces 28 and 30 which engage one another along a closure line 32, the pieces 28 and 30 together defining a wall which bounds the cavity 26 and has the shape of the required piston 10. The boxes 20 are mounted so that they are supported and orientated by the projections formed by the webs 22*c* and 24*c*. These webs, at the right angled corners, extend into recesses 34 in the wall of the die cavity 26 and rest on a abutments in said recesses 34. Thus, the boxes 20 are mounted at the required position for the reaction chambers 16 in the piston 10. The recesses 34 are in the form of vertical grooves extending from one end of the die cavity 26 to the aforementioned abutments on which the webs 22*c* and 24*c* rest. A clamping member (not shown) may be introduced into the grooves 34 to hold the webs 22*c* and 24*c* against the abutments. The ends of the tubes 18 remote from the boxes 20 enter slots 36 in a core. 38 mounted in the die cavity 26. This core 38 is used to define the combustion recess 14. The slots 36 are vented by bores 40 in the core 38.

After mounting the boxes 20 in the die cavity 26, the first illustrative method continues by introducing molten metal, specifically aluminium alloy, into the die cavity 26 so that the metal envelopes the boxes 20 without entering the interiors thereof. Heat from the molten metal causes air in the chambers 16 to be heated and to expand. This causes air to leave the chamber 16 through the tubes 18 and ensures that molten metal does not enter the chambers 16 through the tubes 18.

The molten metal is then allowed to solidify so that a piston blank containing the boxes 20 is formed. The piston blank is then removed from the die cavity 26 and machined to its final shape. This machining machines off the portions of the webs 22*c* and 24*c* which extend beyond the cast metal and also removes the ends of the tubes 18 which projected into the core 38 so that the tubes end flush with the surface of the recess 14.

If desired, the sheets 22 and 24 can be tinned so that they form a bond with the aluminium cast around them so that the assembly of boxes 20 is more tightly bound to the remainder of the piston.

The second, third and fourth illustrative methods differ from the first illustrative method only in the formation of the boxes and supporting projections used. It is, therefore, only necessary to describe these items.

Figure 4:
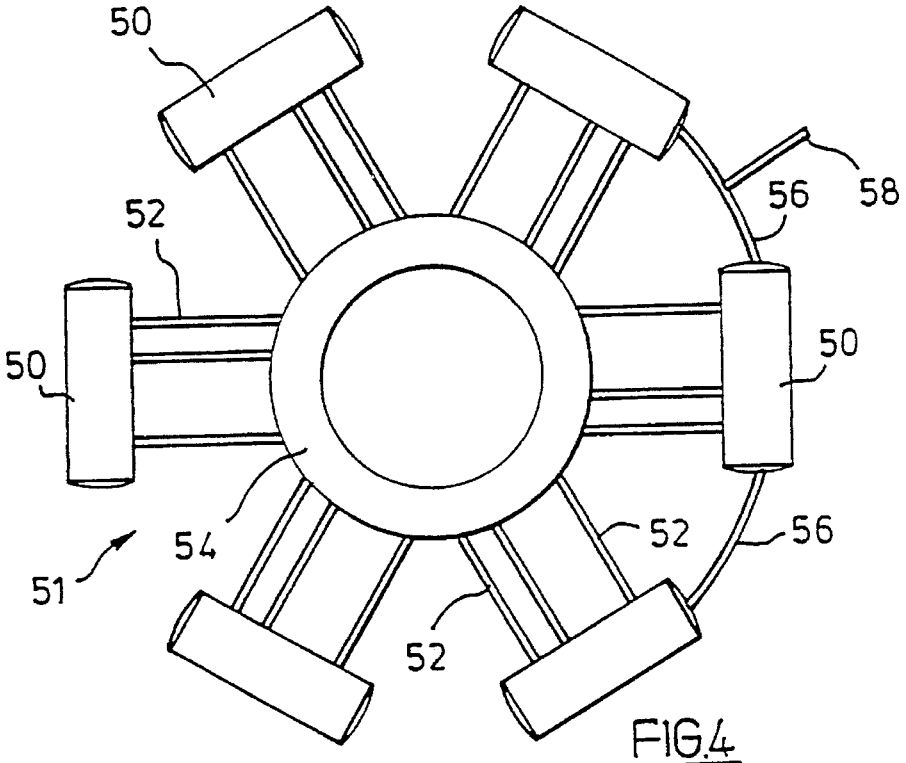
FIGS. 4 and 5 are views similar to FIG. 1 but of assemblies of boxes used in a second and a third illustrative method, respectively.

In the second illustrative method, the assembly 51 of boxes 50 shown in FIG. 4 is used. Each box 50, of which there are six arranged in a circle, is formed from a straight length of tube plugged at each end so that the interior of the tube forms a cavity. Secured in bores through the side wall of the box 50 are three tubes 52 which are similar to the tubes 18. The tubes 52 communicate with the interior of the box 50 and extend inwardly of the assembly 51. At the centre of the assembly 51 is a ring 54 to which inward ends of the tubes 52 are secured. The tubes 52 communicate with a hollow interior of the ring 54 although this is not always necessary.

In the second illustrative method, the tubes 52 are utilised as the external projections of the boxes 50 by which the boxes are supported and orientated. When the boxes 50 are mounted in the die cavity, the ring 54 and inward ends of the tubes 52 enter a recess in the core of the die cavity so that the boxes 50 are supported and orientated in the desired positions. After casting, the tubes 52 are cut through to remove the ring 54 and the machining operation removes the ends of the tubes 52 which project from the cast metal.

A ring similar to the ring 54 can also be used in an assembly generally similar to the assembly 21 described above or to the assembly 71 described below. The use of such a ring has the advantage that the inward ends of the tubes 18, 52 or 72 are held in fixed relationship to one another so that the relationships of the openings to the cavities provided by the boxes 20, 50 or 70 are also fixed. Furthermore, where the tubes 18, 52 or 72 and the ring 54 are used as the sole supporting and orientating projections of the boxes, there is no need to machine off projections from the external surface of the piston.

In modifications of the second illustrative method, the assembly 51 can include arcuate rods 56 providing struts joining adjacent boxes 50 to hold them in position more securely (two such rods 56 are shown in FIG. 4). Additional supporting and orientating projections can be provided by rods 58 projecting outwardly from the centres of the rods 56.

Figure 5:
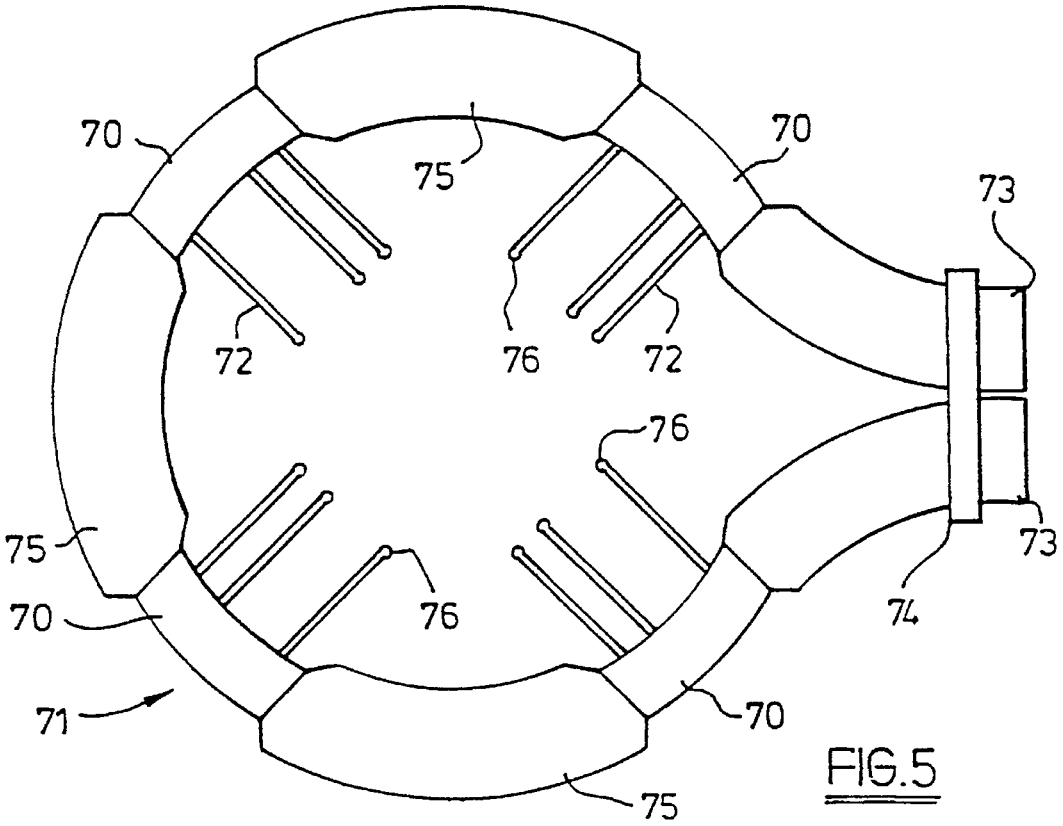

In the third illustrative method, the assembly 71 of boxes 70 shown in FIG. 5 is used. The assembly 71 is formed from a single length of tube which is formed into a circle and has its ends turned outwardly. Areas of the tube, including the outwardly-turned ends, are then crushed flat leaving four uncrushed areas which form the boxes 70. The crushed outwardly-turned ends 73 are joined by a clamp 74 to retain the assembly in shape. Crushed ares 75 provide struts joining the boxes 70. Tubes 72, similar to the tubes 18, extend inwardly from the boxes 70 and communicate with the interiors of the boxes 70. The inward ends 76 of the tubes 72 are crushed to seal them during the casting process.

In the third illustrative method, the crushed outwardly-turned ends 73 are utilised as the supporting and orientating projection by which the boxes 70 are supported in the die cavity. The ends 73 enter a recess in the wall of the die cavity and are clamped in position.

Figure 6:
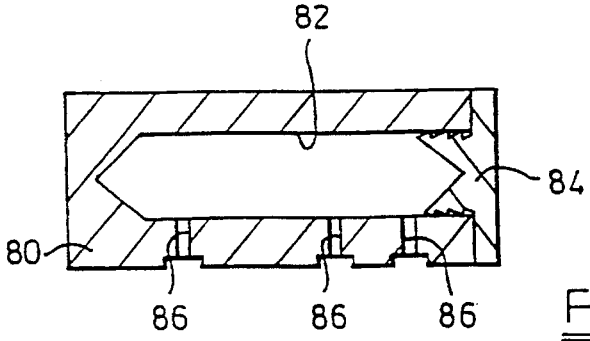
FIG. 6 is a cross-sectional view taken through a box of an assembly used in a fourth illustrative method.

The fourth illustrative method, is identical to the second illustrative method except in the formation of the boxes. Instead of the boxes 50, boxes 80 of the form shown in FIG. 6 are used. The boxes 80 are formed from bar stock by boring a blind bore 82 into one end of the bar, and plugging the open end of the bore 82 with a plug 84. This leaves the bar with an enclosed interior cavity. Next, three stepped bores 86 are formed extending transversely and communicating with the cavity. These bores 86 have an enlarged entrance to receive the tubes 52.

The four illustrative methods each result in a piston 10 comprising cast aluminium alloy which also comprises boxes 20, 50, 70 or 80 enclosed within the cast aluminium alloy, the interior of the boxes defining the size and shape of the cavities 16 within the piston 10. Each cavity has tubes 18, 52 or 72 communicating with the interior of the box and extending through the cast aluminium alloy to an external surface of the piston 10 within the combustion recess 14 thereof so that the tubes provide openings of the cavities. The boxes are in most cases joined to one another by struts 22*c*, 24*c*, 56 or 75 extending through the cast aluminium alloy.

I claim:

1. A method of manufacturing a piston (10) having a cavity (16) therein, wherein the method comprises forming a box (20; 50; 70; 80), the box having an interior which is the size and shape of the required cavity, providing the box with at least one external projection (22*c*, 24*c*; 52; 58; 73) by which the box can be supported, mounting the box in a die cavity (26) bounded by a wall having the shape of the required piston (10), introducing molten metal into the die cavity so that the metal envelopes the box without entering the interior thereof, allowing the metal to solidify, and removing the piston from the die cavity, characterised in that said box (20; 50; 70; 80) is mounted in the die cavity (26) with said external projection extending into a recess (34) in the wall of the die cavity and resting on an abutment in said recess so that said projection serves to support and orientate the box in the cavity, machining off the portion of the projection which extends beyond the cast metal after the piston has been removed from the die cavity, and forming an opening of said cavity in a combustion recess in a crown of the piston.

2. A method according to claim 1, characterised in that the box ( 20; 50; 70; 80 ) is formed with at least one tube (18; 52; 72) projecting therefrom, the tube forming at least part of said opening of said cavity (16).

3. A method according to claim 2, characterised in that said tube (18) is used to allow the air to vent from the interior of the box (20) during casting of the metal.

4. A method according to claim 2, characterised in that said tube (52) is utilised as said external projection by which the box (50) is supported and orientated.

5. A method according to claim 1, characterised in that the box (20; 50; 70; 80) is formed as part of an assembly (21; 51; 71) of similar boxes each enclosing a reaction chamber, the boxes being held in fixed positions relative to one another.

6. A method according to claim 1, characterised in that the box or boxes (20) are formed from two pieces of sheet metal (22, 24) in each of which at least one recess (22*a*, 24*a*) is formed, which are then placed in overlying relationship so that the recesses cooperate in forming a cavity, and which are then joined together.

7. A method according to claim 1, characterised in that the box or boxes (50; 70) are formed from sheet material in tubular form.

* * * * *

UNITED STATES PATENT AND TRADEMARK OFFICE

CERTIFICATE OF CORRECTION

PATENT NO. : 5,551,388

DATED : September 3, 1996

INVENTOR(S) : Slee

It is certified that error appears in the above-identified patent and that said Letters Patent is hereby corrected as shown below:

On the cover page, under the section entitled ABSTRACT, all reference characters should be deleted Column 3, line 3, "Which" should be –which–

Column 3, between lines 27 and 28, insert the following two paragraphs:

–The boxes 20 are assembled by positioning the sheets 22 and 24 in overlying relationship with another so that each recess 22a and 24a is aligned with a recess in the other sheet and the flanges 22b and 24b and the webs 22c and 24c overlie one another. The tubes 18 are positioned between the flanges 22b and 24b. The edges of the flanges 22b, which extend further than the flanges 24b, are turned over the edges of the flanges 24b to secure the sheets 22 and 24 together. Alternatively, the flanges 22b and 24b may be welded together.–

UNITED STATES PATENT AND TRADEMARK OFFICE

CERTIFICATE OF CORRECTION

PATENT NO. : 5,551,388

DATED : September 3, 1996

INVENTOR(S) : Slee

It is certified that error appears in the above-identified patent and that said Letters Patent is hereby corrected as shown below:

--The sheets 22 and 24, thus, form four boxes 20 which are held in a fixed relationship to one another by the webs 22c and 24c. The enclosed interior of each box 20 is designed to form a reaction chamber 16 and the four chambers 16 are held in the positions relative to one another which they will occupy in the finished piston 10.--

Column 3, line 57, delete " . " after "core"

In the Claims, all reference characters should be deleted

Signed and Sealed this

Fifth Day of August, 1997

Bruce Lehman

*Attest:*

BRUCE LEHMAN

*Attesting Officer*

*Commissioner of Patents and Trademarks*